US008839624B2

(12) United States Patent
Schnell et al.

(10) Patent No.: US 8,839,624 B2
(45) Date of Patent: Sep. 23, 2014

(54) COMBUSTION DEVICE OF A GAS TURBINE INCLUDING A PLURALITY OF PASSAGES AND CHAMBERS DEFINING HELMHOLTZ RESONATORS

(75) Inventors: Alexander Schnell, Baden (CH); Nicolas Noiray, Wettingen (CH); Felix Reinert, Wettingen (CH); Diane Lauffer, Wettingen (CH); Bruno Schuermans, La-Tour-de-Peilz (CH)

(73) Assignee: Alstom Technology Ltd., Baden (CH)

( * ) Notice: Subject to any disclaimer, the term of this patent is extended or adjusted under 35 U.S.C. 154(b) by 822 days.

(21) Appl. No.: 12/871,310

(22) Filed: Aug. 30, 2010

(65) Prior Publication Data

US 2011/0048018 A1 Mar. 3, 2011

(30) Foreign Application Priority Data

Aug. 31, 2009 (EP) ..... 09169091

(51) Int. Cl.
*F02C 7/24* (2006.01)
*F23R 3/00* (2006.01)

(52) U.S. Cl.
CPC ..... *F23R 3/002* (2013.01); *F23M 99/005* (2013.01); *F23R 2900/00014* (2013.01)
USPC ..... 60/725; 60/752; 431/114

(58) Field of Classification Search
USPC ..... 60/725, 752–760; 431/114
See application file for complete search history.

(56) References Cited

U.S. PATENT DOCUMENTS 5,373,695 A * 12/1994 Aigner et al. ..... 60/804
5,644,918 A * 7/1997 Gulati et al. ..... 60/725
6,351,947 B1 * 3/2002 Keller et al. ..... 60/725
6,981,358 B2 * 1/2006 Bellucci et al. ..... 60/39.17
7,076,956 B2 * 7/2006 Young et al. ..... 60/725
7,080,514 B2 * 7/2006 Bland et al. ..... 60/725
7,089,741 B2 * 8/2006 Ikeda et al. ..... 60/725
7,334,408 B2 * 2/2008 Bethke et al. ..... 60/725
7,337,875 B2 * 3/2008 Proscia et al. ..... 181/214

(Continued)

FOREIGN PATENT DOCUMENTS

DE 19640980 A1 * 4/1998 ..... F23R 3/02
EP 0892216 A1 1/1999
EP 0990851 A1 4/2000
JP 2009062977 A 3/2009

OTHER PUBLICATIONS

European Search Report for EP09169091 completed Jan. 18, 2010.

(Continued)

*Primary Examiner* — Ehud Gartenberg
*Assistant Examiner* — Lorne Meade
(74) *Attorney, Agent, or Firm* — Buchanan Ingersoll & Rooney PC

(57) ABSTRACT

A combustion device for a gas turbine that includes a portion having first and second walls that defines an inside of the combustion device, a zone between the first and second walls and an outside of the combustion device. A plurality of first passages connect the inside of the combustion device to the zone between the first and second walls and a plurality of second passages connect the zone between the first and second walls to the outside of the combustion device. A plurality of chambers are defined within the zone between the first and second walls, each chamber being connected with one first passage and at least one second passage. Each chamber defining a Helmholtz damper.

17 Claims, 2 Drawing Sheets

(56) References Cited

U.S. PATENT DOCUMENTS

| | | | | |
|---|---|---|---|---|
| 7,448,215 | B2 * | 11/2008 | Macquisten et al. | 60/725 |
| 7,461,719 | B2 * | 12/2008 | Tobik et al. | 181/213 |
| 7,549,290 | B2 * | 6/2009 | Holt et al. | 60/725 |
| 7,549,506 | B2 * | 6/2009 | Sattinger | 181/213 |
| 7,788,926 | B2 * | 9/2010 | Johnson et al. | 60/725 |
| 7,857,094 | B2 * | 12/2010 | Macquisten et al. | 181/250 |
| 2005/0223707 | A1 * | 10/2005 | Ikeda et al. | 60/725 |
| 2005/0229581 | A1 * | 10/2005 | Bellucci et al. | 60/39.17 |
| 2006/0123791 | A1 * | 6/2006 | Macquisten et al. | 60/725 |
| 2006/0207259 | A1 * | 9/2006 | Holt et al. | 60/772 |
| 2008/0087019 | A1 * | 4/2008 | Macquisten et al. | 60/725 |
| 2008/0216481 | A1 * | 9/2008 | Pollarolo | 60/725 |
| 2009/0084100 | A1 * | 4/2009 | Johnson et al. | 60/375 |
| 2010/0236245 | A1 * | 9/2010 | Johnson et al. | 60/725 |
| 2011/0048018 | A1 * | 3/2011 | Schnell et al. | 60/722 |
| 2011/0162910 | A1 | 7/2011 | Chiou et al. | |
| 2011/0203250 | A1 * | 8/2011 | Huber et al. | 60/39.23 |
| 2011/0265484 | A1 * | 11/2011 | Huber et al. | 60/755 |

OTHER PUBLICATIONS

Notification of Reasons for Refusal issued on May 7, 2014 by the Japanese Patent Office in corresponding Japanese Patent Application No. 2010-191725, and English translation thereof. (10 pages).

* cited by examiner

COMBUSTION DEVICE OF A GAS TURBINE INCLUDING A PLURALITY OF PASSAGES AND CHAMBERS DEFINING HELMHOLTZ RESONATORS

CROSS-REFERENCE TO RELATED APPLICATIONS

This application claims priority from EP Patent Application No. 091 69 091.7, filed Aug. 31, 2009, which is hereby incorporated by reference herein in its entirety.

FIELD

The present invention relates to a combustion device of a gas turbine, and particularly relates to a damping system of a combustion device.

In different embodiments, the combustion device may be the first and/or the second combustion device of a sequential combustion gas turbine or a combustion device of a traditional gas turbine (i.e. a gas turbine not being a sequential combustion gas turbine).

For sake of simplicity and clarity, in the following only reference to a reheat combustion device (i.e. the second combustion device of a sequential combustion gas turbine) is made.

BACKGROUND OF THE INVENTION

In gas turbines, during operation, heavy thermo acoustic (i.e. pressure) pulsations can occur in the combustion chamber, because of an incorrect combustion of the fuel (such as gas or oil).

These pulsations subject the hardware of the combustion device and the turbine to heavy mechanical vibrations that can result in the damage of individual parts of the combustion device or turbine.

In order to absorb such pulsations, combustion devices are usually provided with dampers, such as the Helmholtz dampers.

Helmholtz dampers consist of a resonance chamber that is connected via a damping tube to the interior of the combustion chamber (or the medium surrounding the combustion chamber).

When the volume of the chamber, the length of the tube and the area of the tube are in a defined ratio with each other, such a system is able to damp acoustic pulsations (i.e. pressure pulsations) in a certain frequency band.

Usual reheat combustion devices have one Helmholtz damper with the tube connected to the inner of the combustion chamber.

Nevertheless, as these systems only have one single Helmholtz damper for each device (therefore the damping area, corresponding to the cross section of the tube, is very small when compared with the total area of the device exposed to acoustic pulsations), their damping effect is very poor.

US2005/0229581 describes a reheat combustion device that has a mixing tube followed by a combustion chamber; the mixing tube has at its front panel an acoustic screen provided with holes and, parallel to it, an impingement plate also provided with holes.

The acoustic screen and the impingement plate define a chamber connected to the inner of the combustion chamber (via the holes of the acoustic screen) and to the outer of the combustion chamber (via the holes of the impingement plate).

During operation, air (from the compressor) passes through the holes of the impingement plate, impinges on the acoustic screen and then enters the combustion chamber; this lets the acoustic screen and the impingement plate be cooled.

Moreover, the chamber between the impingement plate and acoustic screen defines a plurality of Helmholtz dampers such that, since a plurality of dampers are associated to each reheat combustion device, the damping effect is improved.

Nevertheless, also this damping system has a plurality of drawbacks.

In fact, during operation hot gases may enter from the combustion chamber into the chamber between the impingement plate and the acoustic screen and go out again, coming back into the combustion chamber.

Usually when this occurs, the hot gases recirculate passing through two adjacent holes of the acoustic screen; this phenomenon is known as ingestion.

If ingestion occurs, the hot air flow that recirculates makes the acoustic screen and impingement plate burn in a very short time.

This could be prevented by increasing the air entering from the outside into the chamber between the impingement plate and acoustic screen through the holes of the impingement plate, but this would cause the air within the combustion chamber, that does not take part in the combustion, be increased and, consequently, the NOx emissions be increased.

A further drawback of ingestion is that of detuning of the acoustic damper.

In fact, as the temperature increases in case of hot gas ingestion, the speed of sound also increases in the damping device and, for a given geometry, the range of efficient damping is shifted off the target pulsation frequency. This makes the damper acoustically inefficient.

Moreover, as the air flow within the chamber between the impingement plate and the acoustic screen is not guided, the cooling efficiency is not optimised; this makes different parts of the combustion chamber to be cooled in different way and to operate at different temperatures.

In addition, manufacturing is very hard.

SUMMARY OF THE INVENTION

In an embodiment, the present invention provides a combustion device for a gas turbine that includes a portion having first and second walls that defines an inside of the combustion device, a zone between the first and second walls and an outside of the combustion device. A plurality of first passages connect the inside of the combustion device to the zone between the first and second walls and a plurality of second passages connect the zone between the first and second walls to the outside of the combustion device. A plurality of chambers are defined within the zone between the first and second walls, each chamber being connected with one first passage and at least one second passage. Each chamber defining a Helmholtz damper.

BRIEF DESCRIPTION OF THE DRAWINGS

Exemplary embodiments of the invention are described in more detail in the following with reference to accompanying drawings, in which.

DETAILED DESCRIPTION OF THE INVENTION

Figure 1:
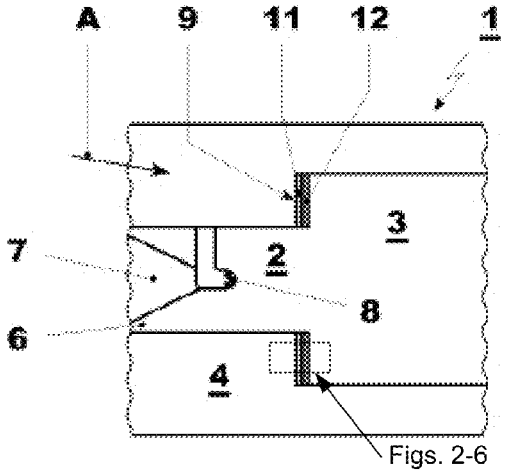
FIG. 1 is a schematic view of a reheat combustion device.

An aspect of the invention is to provide a combustion device that avoids detuning of the acoustic damper and has a good cooling efficiency, such that the temperature of the combustion chamber is more uniform than in traditional combustion devices.

With reference to the figures, these show a reheat combustion device for a gas turbine, indicated overall by the reference number 1.

Upstream of the reheat combustion device a compressor followed by a first combustion chamber and a high pressure turbine are provided.

From the high pressure turbine the hot gases are fed into the reheat combustion device 1, wherein fuel is injected to be combusted; thus a low pressure turbine expands the combusted flow coming from the reheat combustion device 1.

In particular, the reheat combustion device 1 comprises a mixing tube 2 and a combustion chamber 3 inserted in a plenum 4 wherein air A from the compressor is fed.

The mixing tube 2 is arranged to be fed with the hot gases through an inlet 6 and is provided with vortex generators 7 (usually four vortex generators extending from the four walls of the mixing tube, for sake of clarity only one of the four vortex generators is shown in FIG. 1) and a lance that has nozzles 8 for injecting fuel within the hot gases and generate the mixture.

Downstream of the mixing tube 2, the device 1 has the combustion chamber 3 arranged to be fed with the mixture and burn it.

The combustion device 1 comprises a portion 9 provided with a first and a second wall 11, 12 provided with first passages 14 connecting the zone between the first and second wall 11, 12 to the inner of the combustion device 1 and second passages 15 connecting said zone between the first and second wall 11, 12 to the outer of the combustion device 1.

For sake of clarity, in the following the portion 9 is described as the portion at the front panel of the mixing tube, it is anyhow clear that the portion 9 can be located in any position of the mixing tube 2 and/or combustion chamber 3.

Between the first and second wall 11, 12 a plurality of chambers 17 are defined, each chamber 17 being connected with one first passage 14 and one (or also more than one) second passages 15 and defining a Helmholtz damper.

The chambers 17 can be defined by one (or in a different embodiment more than one) first plate 16 interposed between the first and second wall 11, 12.

In embodiments of the invention, the chambers 17 are defined by holes indented in the first plate 16.

Figure 2:
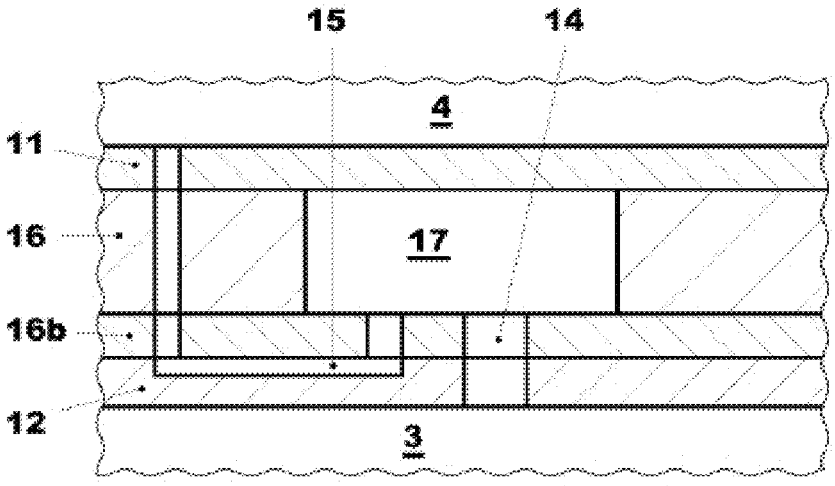
FIGS. 2, 3 are cross sections of the front panel of a mixing tube in accordance with embodiments of the invention with chambers defined by through holes.
Figure 3:
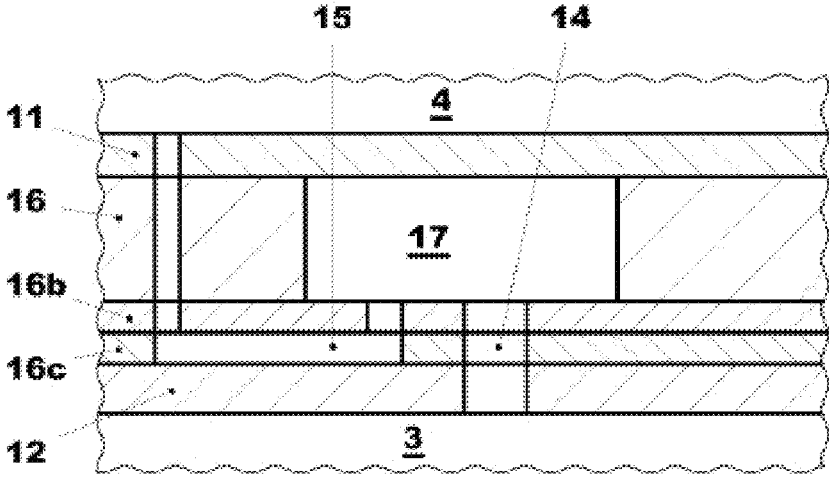

In particular, the holes defining the chambers 17 can be through holes (FIGS. 2 and 3).

In this embodiment, the combustion device 1 may also comprise a second plate 16*b* laying side-by-side with the first plate 16, defining at least a side of the chamber 17 and also defining the first and/or second passages 14, 15 (FIGS. 2 and 3).

In addition, the combustion device may also comprise a third plate 16*c* coupled to the second plate 16*b* and also defining the first and/or second passages 14, 15 (FIG. 3).

In particular, in order to define the second passages 15, the second plate 16*b* has through holes and the third plate 16*c* has through slots connected one another.

Figure 5:
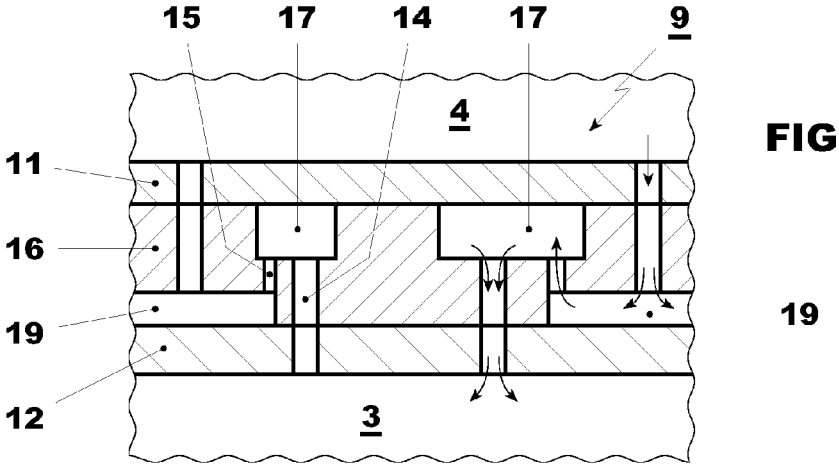

In different embodiments, the holes defining the chambers 17 are blind holes of the first plate 16 (FIG. 5).

Figure 6:
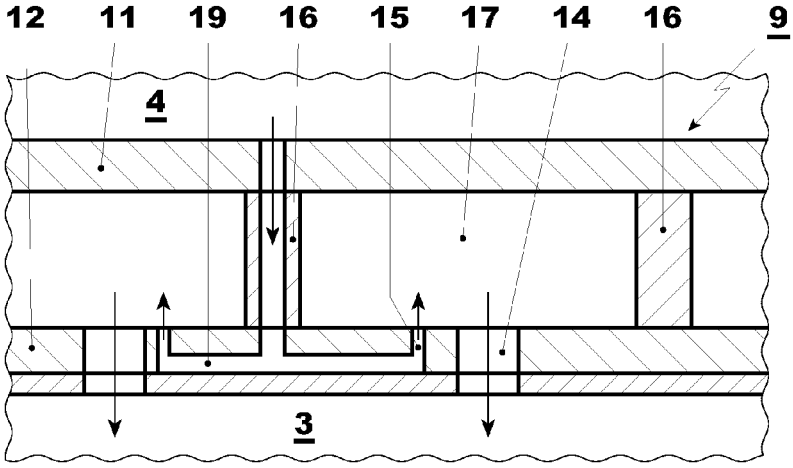
FIG. 6 is a cross section of the front panel of a mixing tube in accordance with embodiments of the invention with chambers defined by a spacer.

In further embodiments the combustion device has a plurality of first plates 16 defining a spacer grid interposed between the first and second walls 11, 12 to define the chambers 17 (FIG. 6).

Figure 4:
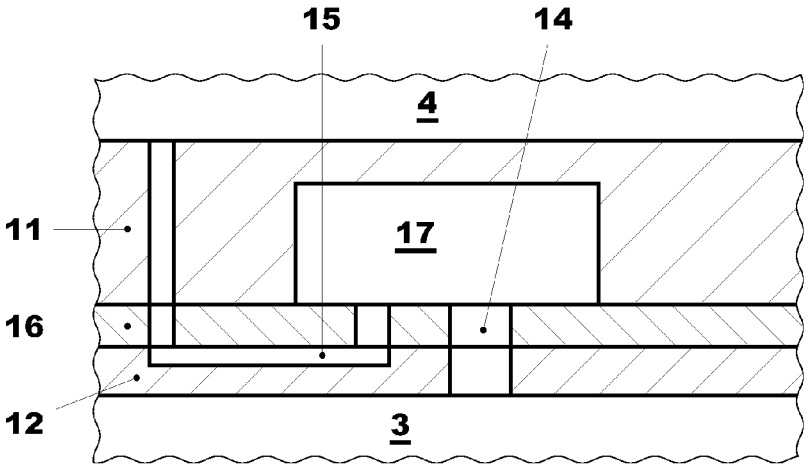
FIGS. 4, 5 are cross sections of the front panel of a mixing tube in accordance with embodiments of the invention with chambers defined by blind holes.

Alternatively the chambers 17 are defined by blind holes indented in the first and/or second wall 11, 12 (FIG. 4).

In case the blind holes are indented in the first and/or second wall 11, 12, between the walls 11, 12 a plate 16 defining a side of the chamber 17 may be provided or also no plate may be provided, such that the walls 11,12 are directly coupled one another.

The second passages 15 can open at the same side of the chambers 17 as the first passages 14 and each chamber 17 is connected to one single first passage 14 and one single second passage 15.

As known in the art, each gas turbine has a plurality of combustion device placed side-by-side.

All the chambers 17 and first passages 14 of a single combustion device 1 may be the same dimensions that are different from those of the other combustion devices 1 of the same gas turbine; in different embodiments of the invention, the chambers 17 of a single combustion device 1 may have different dimensions. This lets different acoustic pulsations be damped very efficiently in a very wide acoustic pulsation band.

The first plate 16 may be the front panel at the exit of the mixing tube 2 (i.e. this wall is manufactured in one piece with the mixing tube).

All walls and plates may be connected to each other by brazing.

Moreover, the passages 14, 15 and chambers 17 are indented by drilling, laser cut, water jet, milling and so on.

FIG. 2 shows an embodiment of the invention with first wall 11 and second wall 12 enclosing the first plate 16 and the second plate 16*b* connected side-by-side therewith.

The chambers 17 are defined by through holes indented in the first plate 16; moreover the sides of the chambers 17 are defined by the first wall 11 (the side towards the plenum 4) and the second plate 16*b* (the side connected towards the combustion chamber 3).

The first passage 14 connecting the inner of the chambers 17 to the combustion chamber 3 is drilled in the second wall 12 and second plate 16*b*.

The second passage 15 comprises a portion drilled in the second plate 16*b* and opening in the chamber 17, and a further portion milled in the second wall 12, and further portions drilled in the second plate 16*b*, in the first plate 16 and in the first wall 11 opening in the plane 4.

FIG. 3 shows a further embodiment of the invention with the third plate 16*c* connected to the second plate 16*b*.

In this embodiment the chambers 17 are defined by through holes of the first plate 16 delimited by the first wall 11 and second plate 16*b*.

The first passages 14 are drilled in the second and third plates 16*b*, 16*c* and in the second wall 12.

The second passage 15 has two spaced apart portions drilled in the second plate 16*b* and a portion drilled in the third plate 16*c*, connecting the before mentioned spaced apart portions drilled in the second plate 16*b*.

Naturally, the second passage 15 also has portions drilled in the first plate 16 and first wall 11.

This embodiment is particularly advantageous, because the chambers 17, and the first and second passages 14, 15 are defined by through holes and can be manufactured in an easy and fast way for example by drilling, laser cut, water jet and so on.

FIG. 4 shows an embodiment with the chamber indented in the first wall 11 and also defined by a plate 16 that delimits it.

The first passage 14 is drilled in the plate 16 and second wall 12.

The second passage 15 has two spaced apart portions drilled in the plate 16 and connected each other by a portion milled in the second wall; it also has a portion drilled in the first wall 11.

FIG. 5 shows an embodiment with chambers 17 defined by blind holes indented in the first plate 16; the first wall 11 defines the side towards the plenum 4 of the chambers 17.

The first passages 14 are drilled in the first plate 16 and second wall 12 and the second passages 15 are drilled and milled in the first plate 16 and are also drilled in the first wall 11; in particular reference 19 indicates the part of the second passage 15 milled in the plate 16.

FIG. 6 shows a further embodiment with the first and second walls 11, 12 enclosing a spacer grid made of plates 16 placed at square angle with each other to define a plurality of quadrangular chambers 17.

The first passages 14 are drilled in the second wall 12 and the first passages 15 are drilled and milled in the second wall 12 and also have a portion drilled in the spacer (preferably at the intersection between the plates) and in the first wall 11; reference 19 indicates the part of the second passages 15 milled in the second wall 12 and then covered by a further outer plate.

The operation of the combustion device of the invention is apparent from that described and illustrated and is substantially the following.

Air A from the compressor enters the plenum 4 and, thus, through the second passages 15 enters the chambers 17.

When passing through the passages 15, air cools the first and second walls 11, 12 and also the first plate 16 (and the second and third plate 16*b*, 16*c* when provided).

Afterwards air goes out from the chambers 17 and, passing through the first passages 14, enters the combustion chamber 3.

Each chamber 17 with the first passages 14 constitutes a Helmholtz damper that lets the acoustic pulsations be damped.

The volume of each chamber 17, the length of each first passage 14 and the area of the cross section of each first passage 14 can be selected such that the Helmholtz damper that they define damps acoustic pulsation (i.e. pressure pulsation) in a particular band.

The combustion device of the invention is able to damp acoustic pulsations in a very broad band, since in first embodiments each device is provided with chambers/first passages having fixed dimensions that are different from the dimension of the other devices, and in second embodiments each device has chambers/first passages of different dimensions.

Moreover the area of the cross section of the second passages 15 can be selected such that the air passing through them lets a uniform cooling be achieved in the first wall 11, second wall 12 and plates 16, 16*b*, 16*c*.

In addition, thanks to the very efficient cooling effect achieved via passages 15, less air is required than in traditional devices; this lets the NOx emissions be reduced.

With the device of the invention hot gas ingestion is not critical, because ingestion (i.e. recirculation of the hot gases from the combustion chamber 3 to the chamber 17 and back to the combustion chamber 3) cannot occur, since each chamber 17 only has one single first passage 14 connecting it to the combustion chamber 3.

Naturally the features described may be independently provided from one another.

The combustion device conceived in this manner is susceptible to numerous modifications and variants, all falling within the scope of the inventive concept; moreover all details can be replaced by technically equivalent elements.

In practice the materials used and the dimensions can be chosen at will according to requirements and to the state of the art.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A combustion device for a gas turbine comprising:

a portion including first and second walls and defining an inside of the combustion device, a zone between the first and second walls and an outside of the combustion device;

a plurality of first passages connecting the inside of the combustion device to the zone between the first and second walls;

a plurality of second passages connecting the zone between the first and second walls to the outside of the combustion device; and a plurality of chambers defined within the zone between the first and second walls, each chamber being connected with one first passage and at least one second passage, and each chamber defining a Helmholtz damper, wherein each of the plurality of chambers is connected to a single second passage.

2. A combustion device for a gas turbine comprising: a portion including first and second walls and defining an inside of the combustion device, a zone between the first and second walls and an outside of the combustion device;

a plurality of first passages connecting the inside of the combustion device to the zone between the first and second walls;

a plurality of second passages connecting the zone between the first and second walls to the outside of the combustion device;

a plurality of chambers defined within the zone between the first and second walls, each chamber being connected with one first passage and at least one second passage, and each chamber defining a Helmholtz damper;

a first plate interposed between the first and second walls, wherein the plurality of chambers are defined by at least the first plate; and a second plate defining at least a side of each chamber and at least one of the plurality of first passages and the plurality of second passages.

3. A combustion device for a gas turbine comprising:

a portion including first and second walls and defining an inside of the combustion device, a zone between the first and second walls and an outside of the combustion device;

a plurality of first passages connecting the inside of the combustion device to the zone between the first and second walls;

a plurality of second passages connecting the zone between the first and second walls to the outside of the combustion device; and a plurality of chambers defined within the zone between the first and second walls, each chamber being connected with one first passage and at least one second passage, and each chamber defining a Helmholtz damper;

a first plate interposed between the first and second walls, wherein the plurality of chambers are defined by at least the first plate;

wherein each of the plurality of chambers is defined by a first hole indented in the first plate, and wherein the at least one second passage passes through the first wall to the second wall, which faces the combustion chamber, and extends parallel to the second wall for cooling the second wall before feeding into at least one of the plurality of chambers.

4. The combustion device recited in claim 3, further comprising a second plate, the second plate defining at least a side of each chamber and at least one of the plurality of first passages and the plurality of second passages, wherein each first hole is a through hole.

5. The combustion device recited in claim 4, further comprising a third plate coupled to the second plate, the third plate defining at least one of the plurality of first passages and the plurality of second passages.

6. The combustion device recited in claim 5, wherein each first hole is a through hole, and wherein each second passage is formed by a second through hole in the second plate and a through slot in the third plate.

7. The combustion device recited in claim 3, wherein each first hole is a blind hole.

8. The combustion device recited in claim 3, wherein the first plate defines a spacer grid forming the plurality of chambers.

9. The combustion device recited in claim 3, wherein each of the plurality of chambers is defined by a blind hole indented into one of the first and second walls.

10. The combustion device recited in claim 3, wherein the both of the respective first and second passages corresponding to each of the plurality of chambers open to the respective chamber on a same side of the chamber.

11. The combustion device recited in claim 3, wherein each of the plurality of chambers has the same dimensions.

12. The combustion device recited in claim 3, wherein the plurality of chambers have different dimensions.

13. The combustion device recited in claim 3, wherein each of the plurality of chambers is connected to a single second passage.

14. The combustion device recited in claim 3, wherein each of the plurality of second passages include a first section normal to the first wall, a second section parallel to the second wall, and a third section normal to the second wall, the second section being arranged between the first and third sections.

15. A reheat combustion device comprising:

a mixing tube including nozzles; and a combustion chamber disposed downstream of the mixing tube and configured to be fed from the mixing tube;

wherein at least a portion of the mixing tube and combustion chamber includes first and second walls defining an inside of the combustion device, a zone between the first and second walls, and an outside of the combustion device, the portion including:

a plurality of first passages connecting the inside of the combustion device to the zone between the first and second walls;

a plurality of second passages connecting the zone between the first and second walls to the outside of the combustion device;

a plurality of chambers defined within the zone between the first and second walls, each chamber being connected with one first passage and at least one second passage, and each chamber defining a Helmholtz damper; and a first plate interposed between the first and second walls, wherein the plurality of chambers are defined by at least the first plate;

wherein each of the plurality of chambers is defined by a first hole indented in the first plate, and wherein the at least one second passage passes through the first wall to the second wall, which faces the combustion chamber, and extends parallel to the second wall for cooling the second wall before feeding into at least one of the plurality of chambers.

16. The combustion device recited in claim 15, wherein each of the plurality of second passages include a first section normal to the first wall, a second section parallel to the second wall, and a third section normal to the second wall, the second section being arranged between the first and third sections.

17. The combustion device recited in claim 15, wherein each first hole is a through hole.

* * * * *